US012312790B2

(12) United States Patent
Errickson

(10) Patent No.: US 12,312,790 B2
(45) Date of Patent: May 27, 2025

(54) HANDHELD AND OPERATED URINAL DEVICE AND METHOD OF ENHANCING FUNCTIONALITY OF A TOILET

(71) Applicant: Christopher Errickson, Corbin City, NJ (US)

(72) Inventor: Christopher Errickson, Corbin City, NJ (US)

( * ) Notice: Subject to any disclaimer, the term of this patent is extended or adjusted under 35 U.S.C. 154(b) by 0 days.

(21) Appl. No.: 18/546,626

(22) PCT Filed: Dec. 15, 2022

(86) PCT No.: PCT/US2022/081629
§ 371 (c)(1),
(2) Date: Aug. 16, 2023

(87) PCT Pub. No.: WO2024/129123
PCT Pub. Date: Jun. 20, 2024

(65) Prior Publication Data
US 2024/0200318 A1 Jun. 20, 2024

(51) Int. Cl.
*E03D 11/02* (2006.01)
*E03D 13/00* (2006.01)

(52) U.S. Cl.
CPC ..... *E03D 11/025* (2013.01); *E03D 13/002* (2013.01)

(58) Field of Classification Search
CPC ..... E03D 11/025; E03D 13/002
See application file for complete search history.

(56) References Cited

U.S. PATENT DOCUMENTS

| | | | | |
|---|---|---|---|---|
| 4,282,611 | A * | 8/1981 | O'Day | E03D 11/025 4/144.1 |
| 5,010,599 | A | 4/1991 | Nilsson | |
| 5,050,248 | A | 9/1991 | Olivero | |
| 5,499,405 | A * | 3/1996 | Collins | E03D 11/025 4/348 |
| 5,737,779 | A * | 4/1998 | Haddock | E03D 13/00 4/301 |
| 6,408,449 | B1 | 6/2002 | Aguirre | |
| 6,546,566 | B1 * | 4/2003 | Geisel | A47K 11/12 4/144.1 |
| 2004/0003457 | A1 | 1/2004 | Renda | |
| 2020/0217058 | A1 | 7/2020 | Dragomir | |

* cited by examiner

*Primary Examiner* — Janie M Loeppke
(74) *Attorney, Agent, or Firm* — Carson Patents; Gregory D Carson

(57) ABSTRACT

The handheld and finger operated flushing urinal device of the present invention comprises a sleeved receptacle having a back-flow preventing draining mechanism built into the bottom to improve sanitary use even when dropped or placed on the floor, and a method of adding the device to an existing toilet. Further features of the device of the invention include a hanger bracket, a fitted lid for closing said top of said liquid stream receptacle body, a lighted or glow-in-the-dark plastic rim connectively attached around said top of said liquid stream receptacle for use as a visual aiming aid for a user in a darkened room, a female adapter connectively attached around said top of said liquid stream receptacle body, and a disposable insert adapted for lining said interior.

17 Claims, 4 Drawing Sheets

HANDHELD AND OPERATED URINAL DEVICE AND METHOD OF ENHANCING FUNCTIONALITY OF A TOILET

BACKGROUND OF THE INVENTION

Technical Field

This invention relates generally to a urinal in the form of a handheld urinal device integrated into an existing toilet, and that can be added to an existing toilet. This invention relates generally to a urinal in the form of a handheld urinal device integrated into a new toilet, and that can be added to a new toilet. This invention relates generally to a urinal in the form of an independently plumbed handheld urinal device.

This invention relates generally to a urinal in the form of a handheld urinal device having a finger operated flushing function integrated into an existing toilet, and that can be added to an existing toilet. This invention relates generally to a urinal in the form of a handheld urinal device having a finger operated flushing function integrated into a new toilet, and that can be added to a new toilet. This invention relates generally to a urinal in the form of an independently plumbed handheld urinal device having a finger operated flushing function.

This invention relates generally to a urinal in the form of a handheld urinal device having a back-flow prevention drain integrated into an existing toilet, and that can be added to an existing toilet. This invention relates generally to a urinal in the form of a handheld urinal device having a back-flow prevention drain integrated into a new toilet, and that can be added to a new toilet. This invention relates generally to a urinal in the form of an independently plumbed handheld urinal device having a back-flow prevention drain.

This invention relates specifically to a urinal in the form of a handheld urinal device having a finger operated flushing function and a back-flow prevention drain integrated into an existing toilet, and that can be added to an existing toilet. This invention relates specifically to a urinal in the form of a handheld urinal device having a finger operated flushing function and a back-flow prevention drain integrated into a new toilet, and that can be added to a new toilet. This invention relates specifically to a urinal in the form of an independently plumbed handheld urinal device having a finger operated flushing function and a back-flow prevention drain.

Background Art

There are available today urinals that are mounted, moveable, and handheld. Among the handheld urinals there are devices available for integrated into an existing toilet, and that can be added to an existing toilet. There are even some handheld urinals that are flushable.

The handheld urinals available today do not offer back-flow prevention to enable an enhanced user experience wherein the device will not tend to leak out its top when dropped or placed on the floor.

In light of the current art, there is a need for a handheld urinal to better enable more sanitary use by including back-flow prevention drain.

BRIEF SUMMARY OF THE INVENTION

The handheld and finger operated flushing urinal device of the present invention comprises a sleeved receptacle having a back-flow preventing draining mechanism built into the bottom to improve sanitary use even when dropped or placed on the floor.

According one aspect of the present invention there is a handheld urinal device for operable connection to a toilet having a bowl comprising a liquid stream receptacle body having a top, a bottom, and an interior comprised of a back flow prevention wall lining said interior, a handle comprised of a male quick-connect, a flush valve having a push button operatively connected to a spread head positioned through a side of said liquid stream receptacle body proximal to said top, and a one-way check valve having an exit operably connected to said bottom, a drain hose operably connected to said exit, a drain connection plate for positioning said drain hose forming a drain into said bowl, and a water supply line having a female quick-connect operatively connected to said male quick-connect.

According a second aspect of the present invention there is a toilet having a handheld urinal device comprising a toilet comprising a liquid stream receptacle body having a top, a bottom, and an interior comprised of a back flow prevention wall lining said interior, a handle comprised of a male quick-connect, a flush valve having a push button operatively connected to a spread head positioned through a side of said liquid stream receptacle body proximal to said top, and a one-way check valve having an exit operably connected to said bottom, a drain hose operably connected to said exit, a drain connection plate for positioning said drain hose to drain into said bowl, and a water supply line having a female quick-connect operatively connected to said male quick-connect.

Further features of the device of the invention include a hanger bracket, a fitted lid for closing said top of said liquid stream receptacle body, a lighted or glow-in-the-dark plastic rim connectively attached around said top of said liquid stream receptacle for use as a visual aiming aid for a user in a darkened room, a female adapter connectively attached around said top of said liquid stream receptacle body, and a disposable insert adapted for lining said interior.

According a third aspect of the present invention there is a method of installing a handheld urinal device to a toilet having a bowl and a seat having a hinge said handheld urinal device comprising a liquid stream receptacle body having a top, a bottom, and an interior comprised of a back flow prevention wall lining said interior, a handle comprised of a male quick connect, a flush valve having a push button operatively connected to a spread head positioned through a side of said liquid stream receptacle body proximal to said top, and a one-way check valve having an exit operably connected to said bottom, a drain hose operably connected to said exit, a drain connection plate for positioning said drain hose to drain into said bowl, and a water supply line having a female quick-connect operatively connected to said male quick-connect wherein said handheld urinal device is installed by connecting said water supply line to a water supply valve, connecting said drain connection plate to said hinge, and passing said drain hose through said drain connection plate positioned for draining into said bowl.

Further features of the method of the invention include installing a hanger bracket to a side of a tank wall on said toilet, installing a fitted lid over said top of said liquid stream receptacle body, installing a lighted or glow-in-the-dark plastic rim connectively attached around said top of said liquid stream receptacle for use as a visual aiming aid for a user in a darkened room, and installing a female adapter connectively attached around said top of said liquid stream receptacle body.

An advantage of the handheld and finger operated flushing urinal device is the improved sanitation of use resulting from the addition of a back-flow preventing draining mechanism built into the bottom of the urine receptacle chamber/tube.

The invention will now be described, by way of example only, with reference to the accompanying drawings in which:

DETAILED DESCRIPTION OF THE INVENTION

Figure 1:
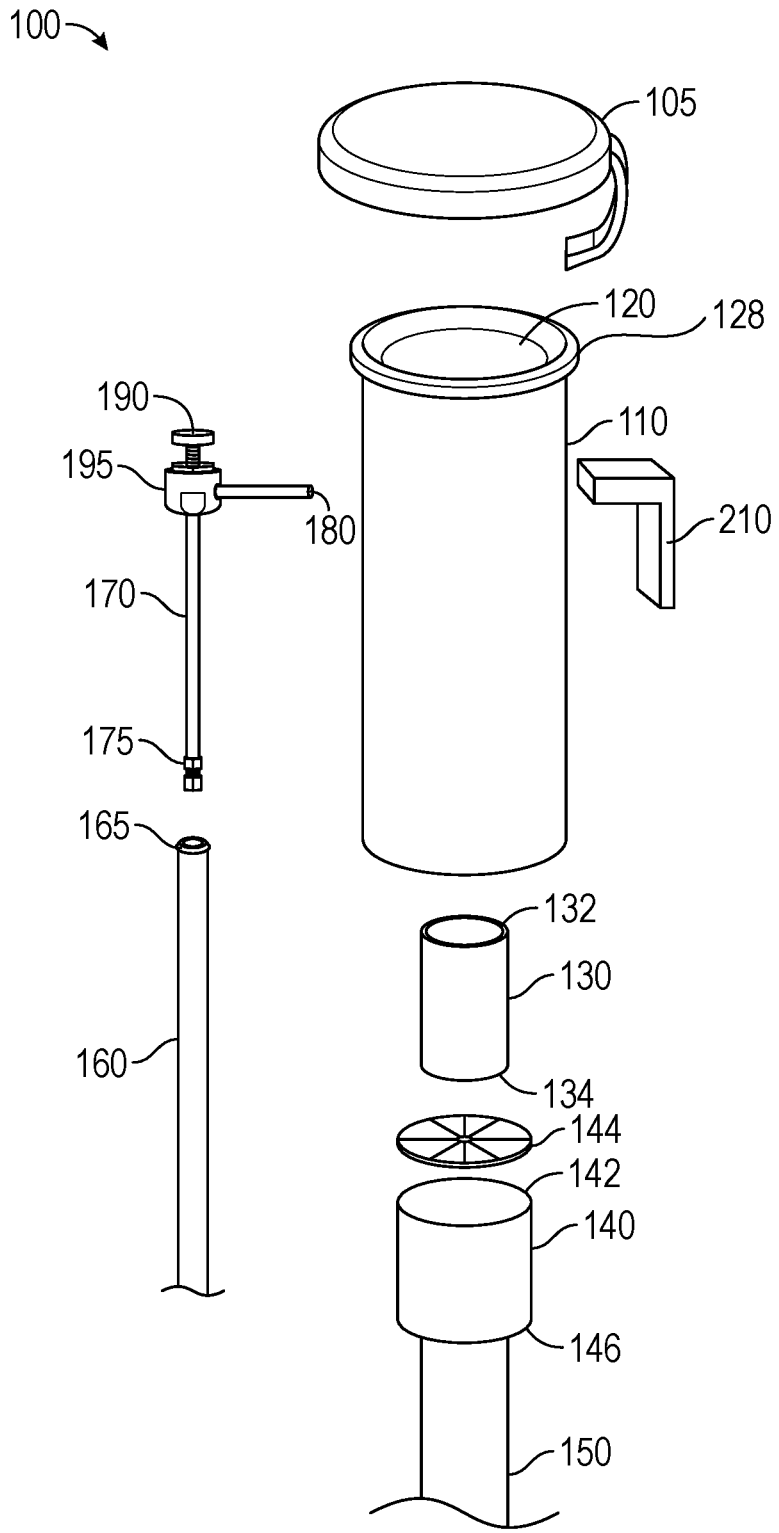
FIG. 1 is an exploded perspective view of the handheld urinal device according to the invention.
Figure 2:
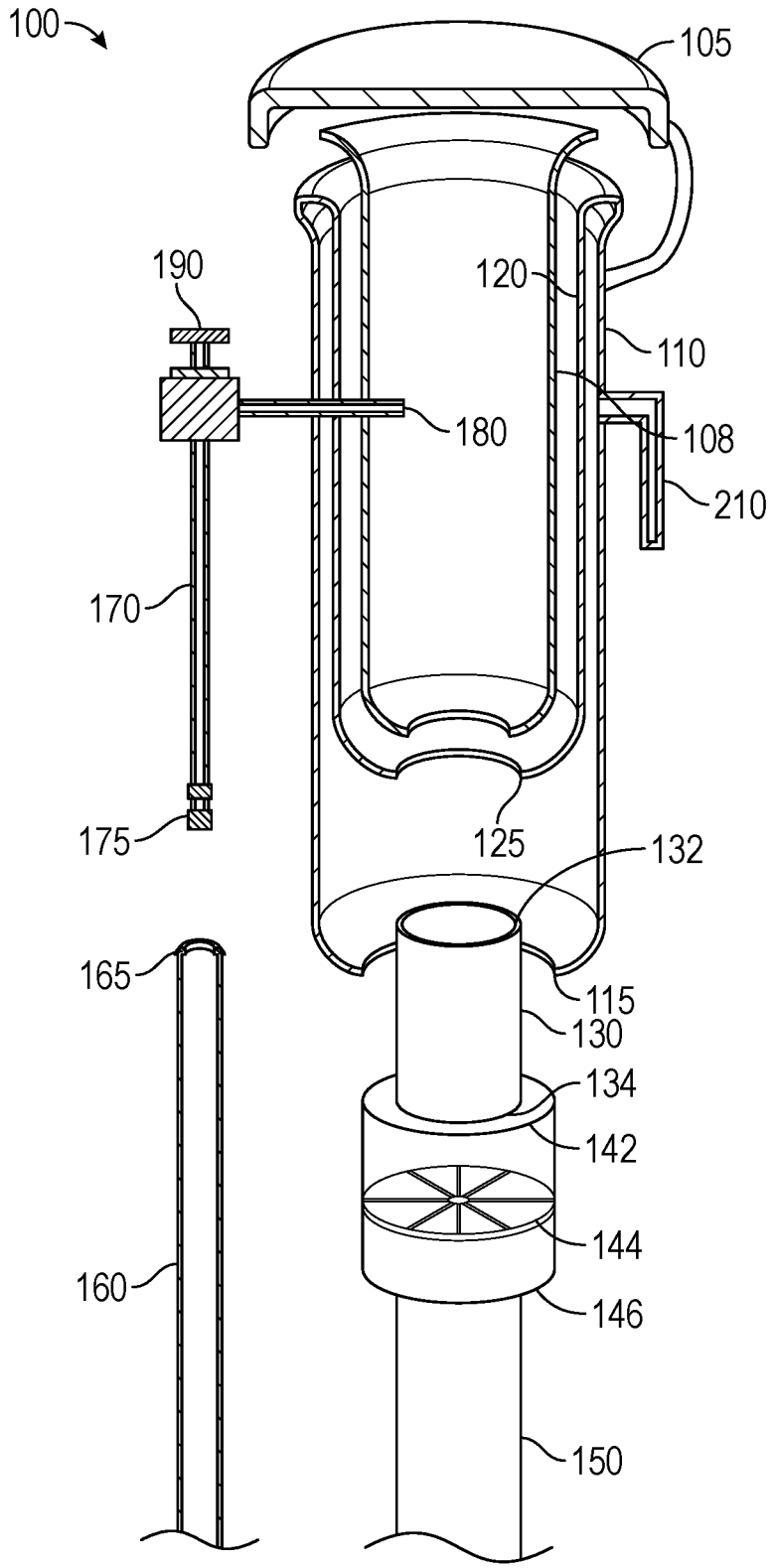
FIG. 2 is an exploded perspective cut away view of the handheld urinal device according to the invention.

The detailed embodiments of the present invention are disclosed herein. The disclosed embodiments are merely exemplary of the invention, which may be embodied in various forms. The details disclosed herein are not to be interpreted as limiting, but merely as the basis for the claims and as a basis for teaching one skilled in the art how to make and use the invention.

References in the specification to "one embodiment," "an embodiment," "an example embodiment," etcetera, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Furthermore, it should be understood that spatial descriptions (e.g., "above," "below," "cup,", "left," "right," "down," "top," "bottom," "vertical," "horizontal," etc.) used herein are for purposes of illustration only, and that practical implementations of the structures described herein can be spatially arranged in any orientation or manner.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

The device of the present invention is manufactured from the usual metal and plastic materials available for use today in building bathroom fixtures.

In one embodiment of manufacturing the device of the present invention the receptacle body with back-flow protection is a open ended cylinder having in internal back-flow prevention wall that is about 200 mm tall by 57.5 mm in circumference at the open urine entry end and having a 1.3 mm diameter drain or exit end. The docking/storage handle with quick connect male fitting for connection to a water supply line is 100 mm tall by 15 mm long and 1.3 mm in diameter, having a push button flush valve made ⅛" brass that is connected to a water supply line having quick connect female fitting. There is an inline one-way check valve to prevent back-flow comprised of a ¾" nipple with a check valve diaphragm. There is a flexible outlet hose to tank spout or drain comprised of ¾" tubing. There is a receptacle hanger bracket that is 50 mm tall by 10 mm long and 1.3 mm thickness. The flushing system spray head is fed by a ⅛" brass pipe from flush valve. The device can optionally include a fitted leak-proof flexible lid for closing the urine entry opening at the top.

In one embodiment of manufacturing the device of the present invention is added to an existing toilet during after its manufacture, with installation following the methods described herein below.

In one embodiment of manufacturing the device of the present invention is added to a new toilet during its manufacture prior to sale, installation, and use, with installation following the methods described herein below.

In one embodiment of manufacturing the device of the present invention is a separate device installed for wall/partition/pole hung storage independently plumbed for operation on its own separated from a toilet.

In one embodiment of the manufacturing method the device of the present invention is added to a new toilet during its manufacture prior to sale, installation, and use.

Index of Labelled Features in Figures. Features are listed below in numeric order. Referring to the Figures, there is shown in FIGS. 1, 2, 3A, 3B, 3C, 3D, 4A and 4B the following features:

Element 100 which is a handheld urinal device.

Element 105 which is a handheld urinal device fitted lid, or snap-fit cover.

Element 108 which is a disposable insert adapted for lining the device.

Element 110 which is a liquid stream receptacle body, or exterior shell.

Element 115 which is a liquid stream receptacle body exterior lining narrowed bottom opening.

Element 120 which is a liquid stream receptacle body interior lining, or back-flow prevention wall.

Element 125 which is a liquid stream receptacle body interior lining narrowed bottom opening.

Element 128 which is a lighted or glow-in-the-dark plastic rim.

Element 130 which is a liquid stream receptacle body drain connector for operationally connecting the exterior lining to the interior lining.

Element 132 which is a connector top end for operational connection of the drain connector to the interior lining.

Element 134 which is a connector bottom end for operational connection of the drain to the exterior lining and/or the one-way check valve assembly.

Element 140 which is a one-way check valve assembly body.

Element 142 which is a one-way check valve entry for draining from the device into a drain.

Element 144 which is a one-way check valve.

Element 145 which is a drain hose exit.

Element 146 which is a one-way check valve exit for connecting to the drain line.

Element 150 which is a drain hose, or drain line.

Element 160 which is a water supply line.

Element 165 which is a female quick connection for a water supply line.

Element 170 which is a handle.

Element 175 which is a male quick connection for a water supply line.

Element 180 which is a spray head.

Element 190 which is a push button for activating the spray head.

Element 195 which is a flush valve.

Element 200 which is a urinal device docking apparatus.

Element 210 which is a docking handle.

Element 220 which is a docking sleeve.

Element 300 which is a drain connection plate.

Element 310 which is a drain connection plate toilet seat connection bolt hole.

Element 320 which is a drain connection plate pass through for holding the drain line in position into the bowl of the toilet.

Element 400 which is a toilet.

Element 410 which is a toilet drain tank wall.

Element 420 which is a toilet bowl.

Element 500 which is a female use adaptor for connection to the handheld urinal device.

Element 510 which is a contoured side wall of a female use adaptor.

Element 520 which is a contoured front end of a female use adaptor.

Element 530 which is a contoured rear end of a female use adaptor.

Element 540 which is a handheld urinal device adaptor connection of a female use adaptor.

In a preferred embodiment of the present invention, there is a handheld urinal device 100 for operable connection to a toilet 400 having a bowl 420 comprising a liquid stream receptacle body 110 having a top, a bottom, and an interior comprised of a back flow prevention wall 120 lining said interior, a handle 170 comprised of a male quick-connect 175, a flush valve 195 having a push button 190 operatively connected to a spread head 180 positioned through a side of said liquid stream receptacle body 110 proximal to said top, and a one-way check valve 144 having an exit operably connected to said bottom, a drain hose 150 operably connected to said exit, a drain connection plate 300 for positioning said drain hose 150 forming a drain into said bowl, and a water supply line 160 having a female quick-connect 165 operatively connected to said male quick-connect 175. Operably positioning the drain hose exit 145 places the drain hose exit 145 into the toilet bowl 420 to enable the flow of effluent from the handheld urinal device 100 into the toilet 400.

In a preferred embodiment of the present invention, there is a handheld urinal device 100 comprising a toilet 400 comprising a liquid stream receptacle body 110 having a top, a bottom, and an interior comprised of a back flow prevention wall 120 lining said interior, a handle 170 comprised of a male quick-connect 175, a flush valve 195 having a push button 190 operatively connected to a spread head 180 positioned through a side of said liquid stream receptacle body 110 proximal to said top, and a one-way check valve 144 having an exit operably connected to said bottom, a drain hose 150 operably connected to said exit, a drain connection plate 300 for positioning said drain hose 150 to drain into said bowl, and a water supply 160 line having a female quick-connect 175 operatively connected to said male quick-connect 165.

The liquid stream receptacle body 110 and the back flow prevention wall 120 placed inside are connectively attached together at a top opening and again at a bottom opening. The liquid stream receptacle body 110 and the back flow prevention wall 120 are connected together by a drain connector 130 having a connector top end 132 for operational connection of the drain connector 130 to the back flow prevention wall 120 and a connector bottom end 134 for operational connection of the drain connector 130 to the liquid stream receptacle body 110 and/or a one-way check valve assembly for enabling back-flow prevention.

There is alternatively a screen or mesh (not shown) placed between the connection of the back flow prevention wall 120 and the liquid stream receptacle body 110 to enable drainage of introduced liquid into the empty space or void between the back flow prevention wall 120 and the liquid stream receptacle body 110.

The a one-way check valve assembly is comprised of an assembly body 140 an entry for draining 142 a one-way check valve 144 and an exit for connecting to the drain line 146.

The space between the back-flow prevention wall 120 surrounding the interior of the liquid stream receptacle body 110 is used for storage of introduced liquid when the device is dropped or placed on the ground. In some embodiments there is a screen and/or mesh (not shown in the figures) introduced at the drain end between the outer shell of device and the back-flow wall liner therein.

The connection plate 300 is a plate comprised of two toilet seat connection bolt holes 310 and a pass through for holding the drain line in position into the bowl 420 of the toilet 400. The connection plate is placed under the toilet seat (not shown) by positioning the toilet seat connection bolt holes 310 under the toilet seat on/over the bolts usually installed on a toilet to retain the toilet seat cover. Alternatively, the connection plate 300 is built into the seat of a toilet so that the drain hose 150 can be positioned as if through the connection plate 300.

Figure 3A:
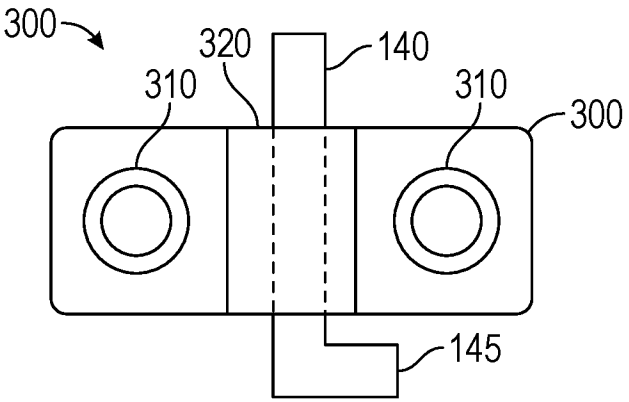
FIG. 3A is a top view showing the toilet bowl attachment device according to the invention.
Figure 3B:
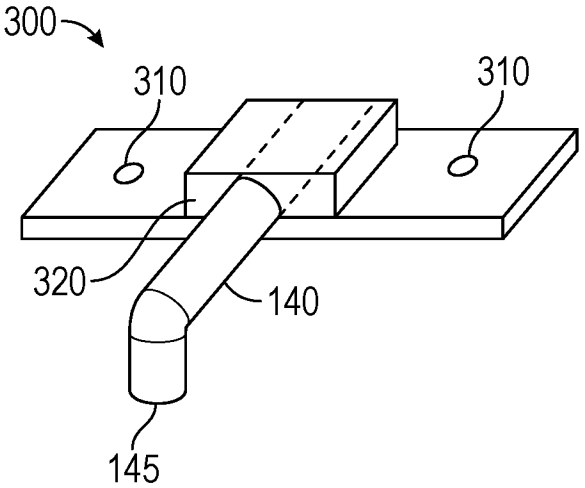
FIG. 3B is a perspective view showing the toilet bowl attachment device according to the invention.
Figure 3C:
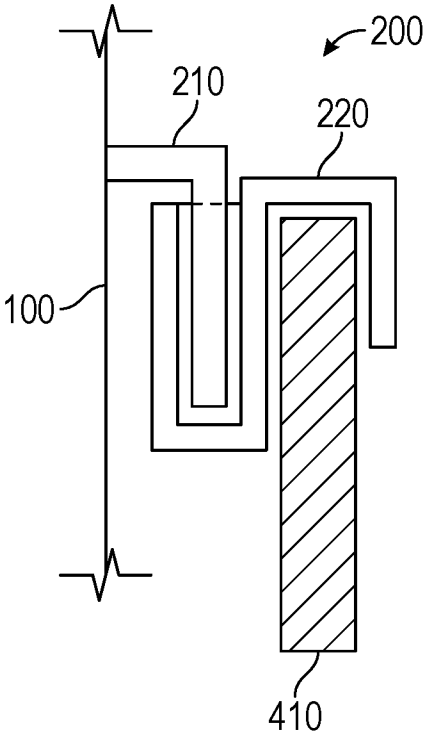
FIG. 3C is a cut away view showing the urinal device handle apparatus according to the invention.
Figure 3D:
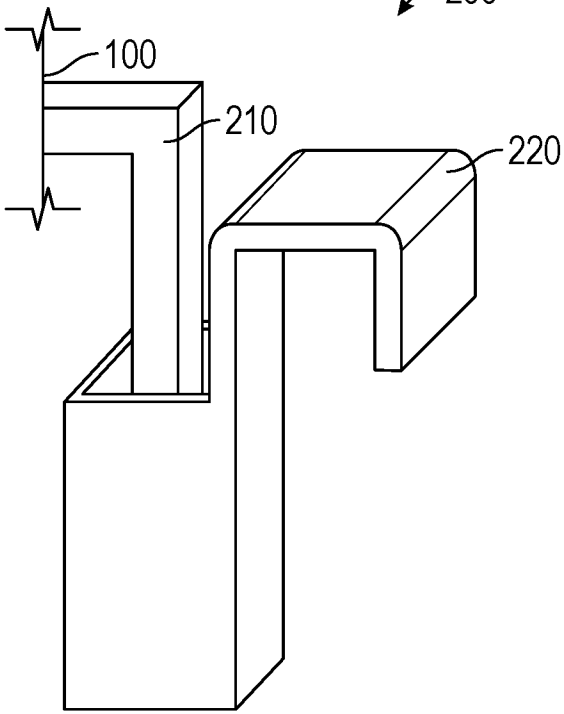
FIG. 3D is a cut away view showing the urinal device handle apparatus according to the invention.
Figure 4A:
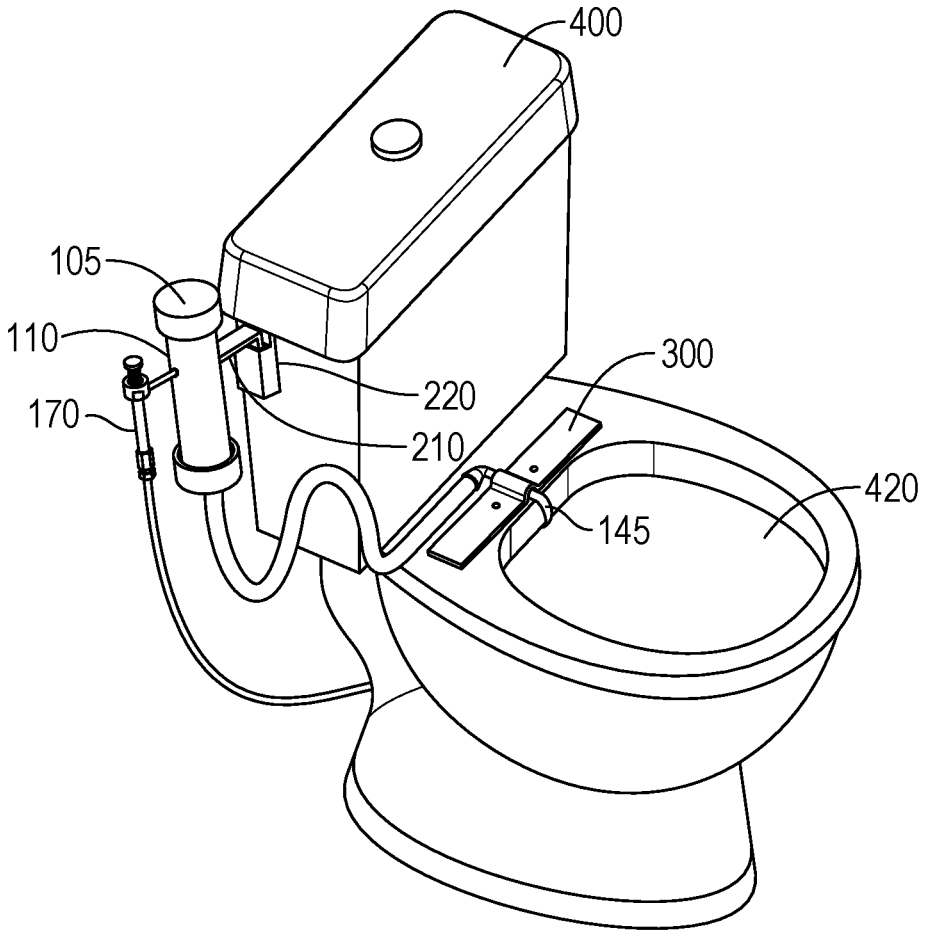
FIG. 4A shows the handheld urinal device handle apparatus operationally attached to a toilet.
Figure 4B:
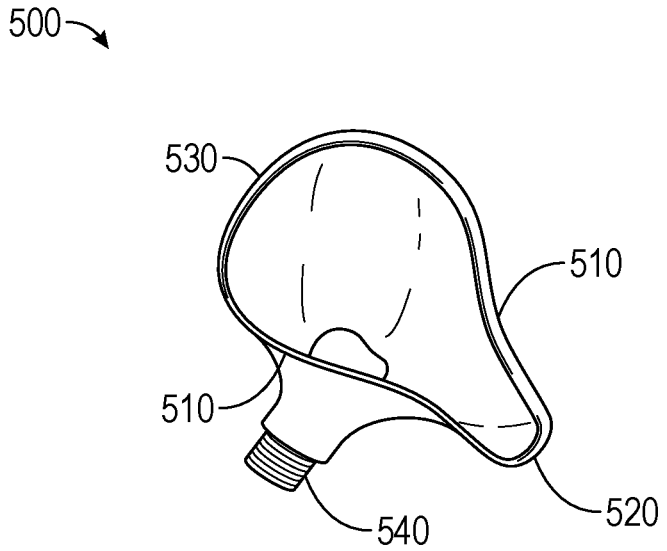
FIG. 4B shows a perspective view of the female use adaptor of the handheld urinal device according to the invention.

In an alternate embodiment of the present invention, there is a handheld urinal device 100 further comprising a hanger bracket 200. The hanger bracket 200 is a device as shown in FIGS. 3C, 3D, and 4A comprised of a docking handle 210 and a docking sleeve 220. The docking handle 210 is connectively attached to the handheld urinal device 100 and is used to dock or stow the device by placing the docking handle 210 into the void (empty space) available within the docking sleeve 220 to hang it. The docking sleeve 220 is hung from the side of the toilet tank as shown in FIG. 4A.

In an alternate embodiment of the present invention, there is a handheld urinal device 100 further comprising a fitted lid 105 for closing said top of said liquid stream receptacle body 110.

In an alternate embodiment of the present invention, there is a handheld urinal device 100 further comprising a lighted or glow-in-the-dark plastic rim 128 connectively attached around said top of said liquid stream receptacle body 110 for use as a visual aiming aid in a darkened room.

In an alternate embodiment of the present invention, there is a handheld urinal device 100 further comprising a female adapter 500 connectively attached around said top of said liquid stream receptacle body 110. The female adapter 500 is comprised of two contoured sides 510, a front 520, and a back 530. The contours of the sides, front, and back of the female adapter 500 are positioned and contoured to match the space between the legs so as to enable an effectively water tight connection enabling splash reduction and/or elimination when used by a female user.

In an alternate embodiment of the present invention, there is a handheld urinal device 100 further comprising a disposable insert 108 adapted for lining said interior. The disposable insert 108 is dimensioned to snuggly fit inside the back flow prevention wall 120 while fitting over and around the spray head 180.

In a preferred embodiment of the present invention, there is a method of installing a handheld urinal device 100 to a toilet 400 having a bowl 420 and a seat having a hinge said handheld urinal device 100 comprising a liquid stream receptacle body 110 having a top, a bottom, and an interior comprised of a back flow prevention wall 120 lining said interior, a handle 170 comprised of a male quick-connect 175, a flush valve 195 having a push button 190 operatively connected to a spread head 180 positioned through a side of said liquid stream receptacle body 110 proximal to said top, and a one-way check valve 144 having an exit operably connected to said bottom, a drain hose 150 operably connected to said exit, a drain connection plate 300 for positioning said drain hose 150 forming a drain into said bowl, and a water supply line 160 having a female quick-connect 165 operatively connected to said male quick-connect 175 wherein said handheld urinal device 100 is installed by connecting said water supply line 160 to a water supply valve, connecting said drain connection plate 300 to said hinge, and passing said drain hose 150 through said drain connection plate 300 positioned for draining into said bowl 420.

The connecting said water supply line 160 to a water supply valve, connecting said drain connection plate 300 to said hinge, and passing said drain hose 150 through said drain connection plate 300 positioned for draining into said bowl 420 is performed as is usual in the plumbing art ensuring the elements are operatively placed and verified for operation prior to use.

In an alternate embodiment of the present invention, there is a method of installing a handheld urinal device 100 to a toilet 400 further comprising installing a hanger bracket 200 to a side of a tank wall on said toilet.

In an alternate embodiment of the present invention, there is a method of installing a handheld urinal device 100 to a toilet 400 further comprising installing a fitted lid 105 over said top of said liquid stream receptacle body 110.

In an alternate embodiment of the present invention, there is a method of installing a handheld urinal device 100 to a toilet 400 further comprising installing a lighted or glow-in-the-dark plastic rim 128 connectively attached around said top of said liquid stream receptacle body 110 for use as a visual aiming aid for a user in a darkened room.

In an alternate embodiment of the present invention, there is a method of installing a handheld urinal device 100 to a toilet 400 further comprising installing a female adapter 500 connectively attached around said top of said liquid stream receptacle body 110.

An advantage of the handheld and finger operated flushing urinal device 100 is an improvement in sanitation of use resulting from the addition of a back-flow preventing draining mechanism built into the bottom of the urine receptacle chamber/tube.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

Although the invention has been explained in relation to various embodiments, it is to be understood that many other possible modifications and variations can be made without departing from the spirit and scope of the invention.

The invention claimed is:

1. A handheld urinal device for operable connection to a toilet having a bowl comprising
- a liquid stream receptacle body having a top, a bottom, and an interior comprised of;
  - a back flow prevention wall lining said interior,
  - a handle comprised of
    - a male quick-connect,
    - a flush valve having a push button operatively connected to a spread head positioned through a side of said liquid stream receptacle body proximal to said top, and
  - a one-way check valve having an exit operably connected to said bottom,
- a drain hose operably connected to said exit,
- a drain connection plate for positioning said drain hose forming a drain into said bowl, and
- a water supply line having a female quick-connect operatively connected to said male quick-connect.

2. The handheld urinal device of claim 1 further comprising a hanger bracket.

3. The handheld urinal device of claim 1 further comprising a fitted lid for closing said top of said liquid stream receptacle body.

4. The handheld urinal device of claim 1 further comprising a lighted or glow-in-the-dark plastic rim connectively attached around said top of said liquid stream receptacle body for use as a visual aiming aid for a user in a darkened room.

5. The handheld urinal device of claim 1 further comprising a female adapter connectively attached around said top of said liquid stream receptacle body.

6. The handheld urinal device of claim 1 further comprising a disposable insert adapted for lining said interior.

7. A toilet having a bowl and a handheld urinal device comprising
- a liquid stream receptacle body having a top, a bottom, and an interior comprised of
  - a back flow prevention wall lining said interior,
  - a handle comprised of
    - a male quick-connect,
    - a flush valve having a push button operatively connected to a spread head positioned through a side of said liquid stream receptacle body proximal to said top, and
  - a one-way check valve having an exit operably connected to said bottom,
- a drain hose operably connected to said exit,
- a drain connection plate for positioning said drain just a hose to drain into said bowl, and
- a water supply line having a female quick-connect operatively connected to said male quick-connect.

8. The toilet of claim 7 wherein said handheld urinal device further comprises a hanger bracket.

9. The toilet of claim 7 wherein said handheld urinal device further comprises a fitted lid for closing said top of said liquid stream receptacle body.

10. The toilet of claim 7 wherein said handheld urinal device further comprises a lighted or glow-in-the-dark plastic rim connectively attached around said top of said liquid stream receptacle body for use as a visual aiming aid for a user in a darkened room.

11. The toilet of claim 7 wherein said handheld urinal device further comprises a female adapter connectively attached around said top of said liquid stream receptacle body.

12. The toilet of claim 7 wherein said handheld urinal device further comprises a disposable insert adapted for lining said interior.

13. A method of installing a handheld urinal device to a toilet having a bowl and a seat having a hinge said handheld urinal device comprising a liquid stream receptacle body having a top, a bottom, and an interior comprised of a back flow prevention wall lining said interior, a handle comprised of a male quick-connect, a flush valve having a push button operatively connected to a spread head positioned through a side of said liquid stream receptacle body proximal to said top, and a one-way check valve having an exit operably connected to said bottom, a drain hose operably connected to said exit, a drain connection plate for positioning said drain hose to drain into said bowl, and a water supply line having a female quick-connect operatively connected to said male quick-connect wherein said handheld urinal device is installed by connecting said water supply line to a water supply valve, connecting said drain connection plate to said hinge, and passing said drain hose through said drain connection plate positioned for draining into said bowl.

14. The method of claim 13 further comprising installing a hanger bracket to a side of a tank wall on said toilet.

15. The method of claim 13 further comprising installing a fitted lid over said top of said liquid stream receptacle body.

16. The method of claim 13 further comprising installing a lighted or glow-in-the-dark plastic rim connectively attached around said top of said liquid stream receptacle body for use as a visual aiming aid for a user in a darkened room.

17. The method of claim 13 further comprising installing a female adapter connectively attached around said top of said liquid stream receptacle body.

* * * * *